United States Patent [19]

Messinger

[11] 4,230,365

[45] Oct. 28, 1980

[54] ARTICLE OF FURNITURE AND METHOD OF MANUFACTURE

[76] Inventor: Alexander Messinger, 3725 Lankenau Rd., Philadelphia, Pa. 19131

[21] Appl. No.: 4,438

[22] Filed: Jan. 18, 1979

[51] Int. Cl.[2] ..... A47C 7/02; A47C 27/00

[52] U.S. Cl. ..... 297/457; 297/218

[58] Field of Search ..... 297/218, 457

[56] References Cited

U.S. PATENT DOCUMENTS

| | | | |
|---|---|---|---|
| D. 174,496 | 4/1955 | Freedman | 297/457 X |
| 2,865,436 | 12/1958 | Thorne | 297/218 X |
| 3,600,035 | 8/1971 | Vondrets | 297/457 X |
| 3,999,802 | 12/1976 | Powers | 297/218 X |

*Primary Examiner*—James C. Mitchell

*Attorney, Agent, or Firm*—Steele, Gould & Fried

[57] ABSTRACT

An article of furniture, and a method for making same, the furniture comprising a self-supporting peripheral frame, having an open central region, and a fabric sleeve, covering said peripheral frame and providing a body support surface. The peripheral frame, which comprises two side rail members and a plurality of braces connecting the rail members, defines a body contour. The fabric sleeve may be impregnated with a resinous material, thereby providing a substantially rigid body support surface, or padding may be disposed between the fabric sleeve and the peripheral frame, thereby providing a softer body support surface. The fabric sleeve may be a one-piece, two-way stretch member, such as different types of knitted materials or a non-stretch member of different types of woven materials. The article of furniture may be formed as a chair, a lounger or recliner or a foot rest. The articles of furniture are easily shaped in keeping with the requirements of the human body by stretching the fabric over a designed contour, thereby providing an inexpensive means for producing customized furniture on a large scale.

21 Claims, 6 Drawing Figures

ARTICLE OF FURNITURE AND METHOD OF MANUFACTURE

BACKGROUND OF THE INVENTION

1. Field of the Invention

This invention relates to the field of furniture and methods of manufacturing furniture. In particular, this invention relates to a simplified method of inexpensively producing customized contoured furniture, which is both eminently practical and striking in appearance.

2. Description of the Prior Art

Heretofore, the known methods for producing customized contoured articles of furniture have been no different than producing generalized contoured furniture, except that the dimensions of the particular artilces of furniture are suited to the dimensions of a particular individual. In conventional furniture, this requires frames, springs or webbing, and thickly padded cushions. In what is commonly referred to as more contemporary furniture, construction still involves frames, perhaps webbing, and often preformed cushioned members. Another contemporary alternative is the use of molded plastic material to form seat and/or back of a chair. These articles of furniture require the utilization of very expensive dies, heavy molding equipment and often costly raw materials. Further, additional pillows are a necessity unless the furniture is very precisely contoured.

Another kind of furniture, which in some aspects bears a superficial resemblance to this invention, is commonly called patio furniture. Such furniture usually comprises a tubular foldable frame which is covered by plastic webbing or pieces of fabric or canvas, which are drawn over different parts of the tubular frame.

This invention provides a method of manufacture by which customized contoured furniture, or for that matter, furniture of general contours, may be easily and inexpensively produced. The various embodiments which may be incorporated into the method of manufacture permits such furniture to be made for indoor as well as outdoor use, and in addition to the advantages noted herein, yields an article of furniture which is strikingly attractive.

SUMMARY OF THE INVENTION

It is an object of this invention to provide an article of furniture which is distinctively styled.

It is a further object of this invention to provide an article of furniture which is not only distinctively styled, but is relatively inexpensive to manufacture.

It is another object of this invention to provide an article of furniture which is distinctively styled, relatively inexpensive to manufacture and suitable for use in virtually any environment.

It is yet another object of this invention to provide a method for manufacturing an article of furniture with generalized body contours.

It is yet another object in this invention to provide a method for manufacturing an article of furniture with customized body contours.

It is still another object of this invention to provide a method for manufacturing an article of furniture which provides for customized body contours and is relatively inexpensive to produce.

It is yet another object of this invention to provide a method for manufacturing articles of furniture with generalized or customized body contours, which is suitable for producing virtually any type of body supporting furniture, such as chairs, loungers or foot rests.

Briefly, and in accordance with the foregoing objects, this invention provides an article of furniture and a method for manufacturing same. An article of furniture according to this invention comprises a self-supporting peripheral frame, having an open central region, and a fabric sleeve covering the peripheral frame and providing a body support surface. The peripheral frame comprises two side rail members and a plurality of braces connecting the rail members, the braces being disposed substantially parallel to the open central region. The body contours of the article of furniture are easily controlled by the shape and dimensions of the side rail members, rendering an article of customized furniture no more difficult or expensive to manufacture than an article of general contour. The fabric sleeve may be impregnated with a resinous material, thereby providing a substantially rigid body support surface, or, padding may be disposed between the fabric sleeve and the peripheral frame, providing a softer body support surface. In the case where the fabric sleeve is impregnated with a resinous material, it may be desirable to cover the article of furniture with a fabric sleeve made from a softer material or with appropriately shaped cushions. An article of furniture with a resin impregnated material and appropriate cushions would make ideal patio or outdoor furniture. In the case where the fabric is not treated with resin, the sleeve can be removed for easy cleaning or changed to provide diversity of color. A resin treated sleeve may also be covered with a removable untreated sleeve. Such removable sleeves may be connected by releasable fasteners, such as zippers or VELCRO strips.

The method of manufacturing furniture according to this invention comprises the steps of forming two side rail members, in the desired contour, and a plurality of cross braces into a peripheral frame, having an open central region, and drawing a fabric sleeve, preferably made from a two-way stretch material, over the peripheral frame, thereby providing a body support surface. Where the peripheral frame is formed in a continuous piece, that is when the side rail members are continuous pieces, the peripheral frame must be opened at one point before drawing the sleeve over the peripheral frame. In this case, the peripheral frame is preferably rejoined after the fabric sleeve is drawn thereover. Various embodiments of an article of furniture according to this invention may be formed by impregnating a fabric sleeve with a resin material after it has been drawn over the peripheral frame, or by securing padding in appropriate places on the peripheral frame prior to drawing the fabric over the peripheral frame. Inasmuch as the methods of this invention are applicable to furniture of almost any contour, the method is suitable for producing chairs, loungers or recliners, foot rests or ottomans, or the like.

BRIEF DESCRIPTION OF THE DRAWINGS

For the purpose of illustrating this invention, there are shown in the drawings forms which are presently preferred; it being understood, however, that this invention is not limited to the precise arrangements and instrumentalities shown. The drawings depict an article of furniture according to this invention in successive stages of construction.

DETAILED DESCRIPTION OF THE PREFERRED EMBODIMENTS

Figure 1:
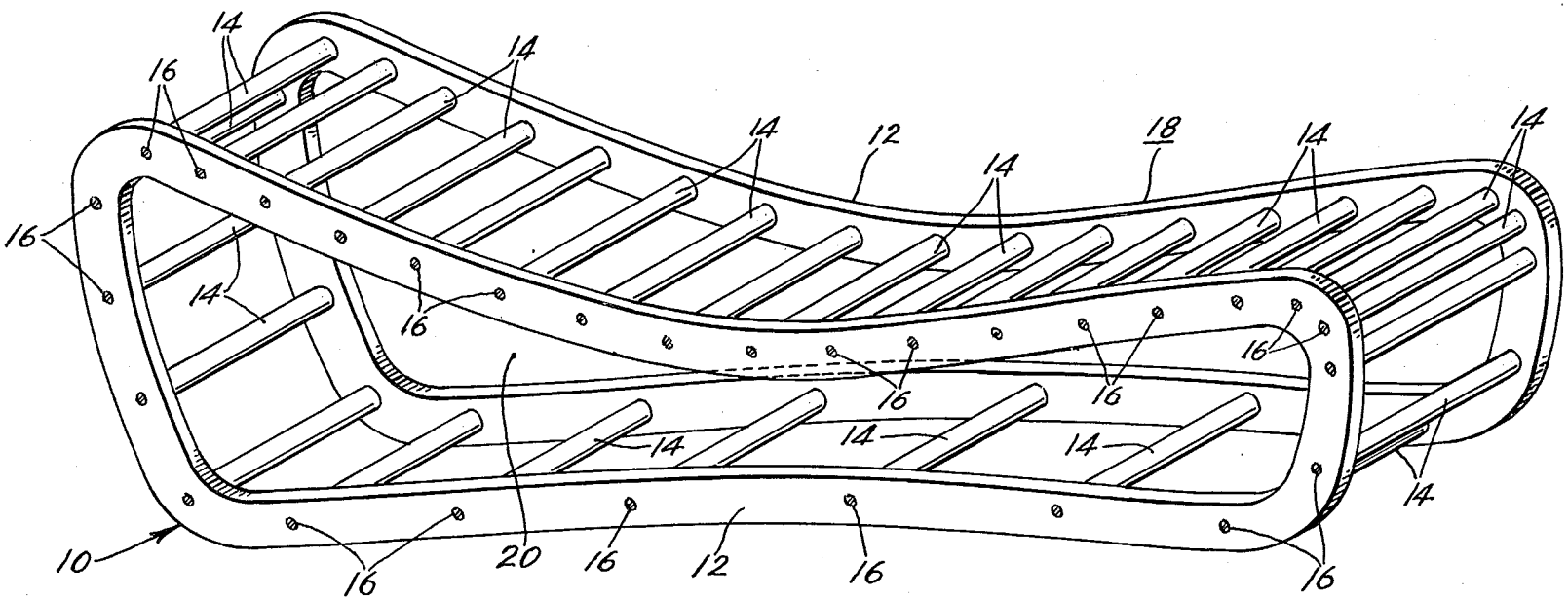
FIG. 1 is a perspective view of the peripheral frame of an article of furniture according to this invention, in the general contour of a recliner or lounger.

Articles of furniture 10 are shown in various contours in the figures. FIG. 1 is in the generalized coutour of a recliner or lounge chair, FIGS. 2–5 are in the general contour of a chair and FIG. 6 is in the general contour of a foot rest or ottoman. In each instance, the structural members and method of manufacture is substantially similar, and accordingly, the structural members will be numbered identically, even though particular contours may differ between the articles shown in the various figures.

Figure 2:
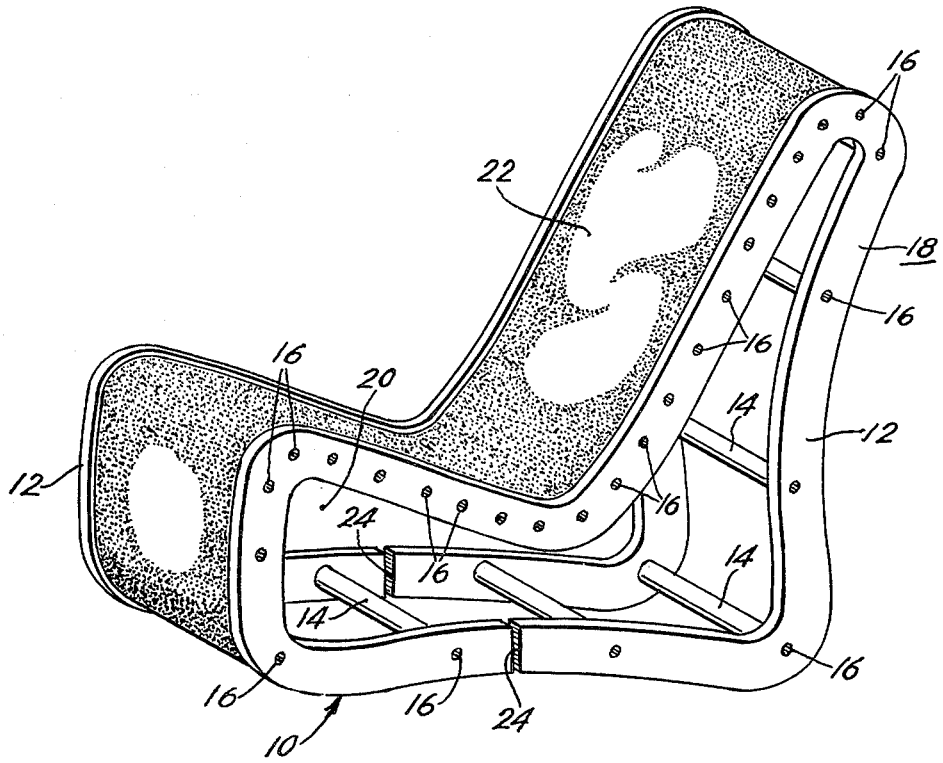
FIG. 2 is a perspective view of an article of furniture according to this invention, in which padding has been secured to the peripheral frame, which has been opened to permit a fabric sleeve to be drawn thereover, the contour of the peripheral frame being generally that of a chair.

With reference to FIGS. 1 and 2, there are two side rail members 12 which are substantially identical. The shape of side rail members 12 determines the overall contour of the article of furniture, and accordingly, is the basis for providing customized furniture at relatively inexpensive cost. The side rail members 12 are joined by a plurality of braces 14. The braces 14 and side rail members 12 are conveniently connected by attachment means 16. The rail frame members 12 and connected braces 14 together form a self-supporting peripheral frame 18 having an open central region 20. It has been found that suitable side rail members may be formed from ¾" thick plywood stock, the rails being approximately 4" wide. The braces 14 may be formed from 1" diameter wooden dowels, which are attached by 1½" long wood screws. Attachment of the dowels may be facilitated by boring through holes in the side rail members and pilot bore holes in the wooden dowels prior to attachment. The attachment means 16 should be flush with the outer surfaces of the side rail members. In the case of wood screws, it would be necessary to provide countersunk holes for the heads of the wood screws. Construction of the peripheral frame 18, in the desired contour, constitutes the first step in the method of constructing an article of furniture according to this invention.

With reference to FIG. 2, the next step in construction is to apply a rubber or foam padding 22, resting on the braces 14 in what will become the body support area of the chair. The padding may be glued, stapled or tacked, in accordance with standard upholstery procedures. There is no reason for attaching padding in the other areas of the chair, but it may be so attached if so desired. Further, it should be noted that in certain embodiments it is desirable to omit the padding 22 entirely, for example, where the fabric sleeve is resin treated.

The next step in construction applies to all articles of furniture with continuously formed side rail members, and involves opening or cutting the frame, preferably near the center of the bottom portion of the rail members, as shown at numerals 24. The openings or breaks 24 facilitate attachment of the fabric sleeve 26, as shown in FIG. 3.

Figure 3:
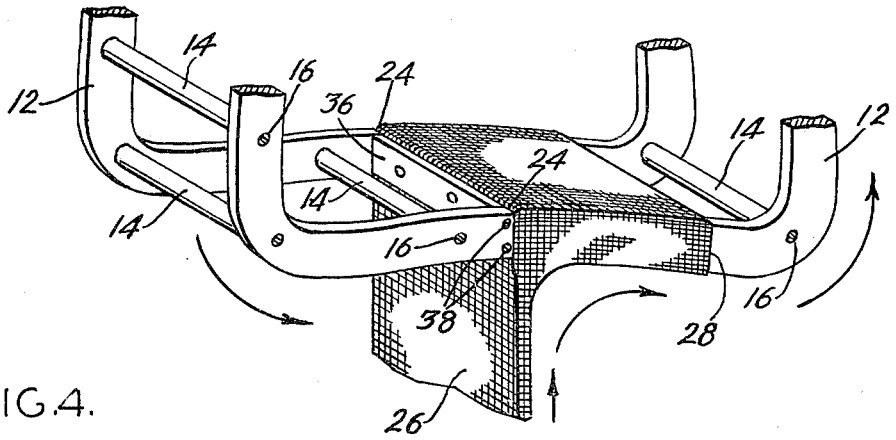
FIG. 3 is a partial view of FIG. 2, showing a fabric sleeve being drawn over the lower portion of the peripheral frame.
Figure 4:
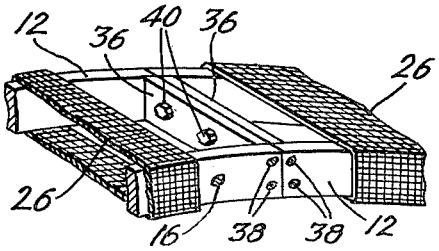
FIG. 4 is the article of furniture shown in FIG. 3, over which the fabric sleeve has been entirely drawn, and then pulled back to facilitate reconnection of the frame.

After the frame has been open or cut, two end members 36, corresponding in dimension to the side rail members, are mounted to the ends of the frames as shown in FIGS. 3 and 4. End members 36 are secured to the side rail members by attachment means 38, such as screws.

The fabric sleeve 26 is preferably formed from a two-way stretch fabric, such as different types of knitted materials, which has been formed or knitted into a long sleeve or sock. The sleeve may also be a non-stretch member of different types of woven materials. After end members 36 are attached, the open end 28 of the fabric sleeve 26 is drawn over the peripheral frame, through the breaks or openings 24 until it completely covers the peripheral frame, as in the direction shown by the arrows, at which point the ends of the sleeve are drawn back from the opening of peripheral frame 18, as shown in FIG. 4. When the sleeve is positioned as shown in FIG. 4, end members 36 may be joined together by attachment means 40. Where it is desirable for the sleeve to be removable, attachment means 40 may be nuts and bolts, for easily reopening the frame.

Figure 5:
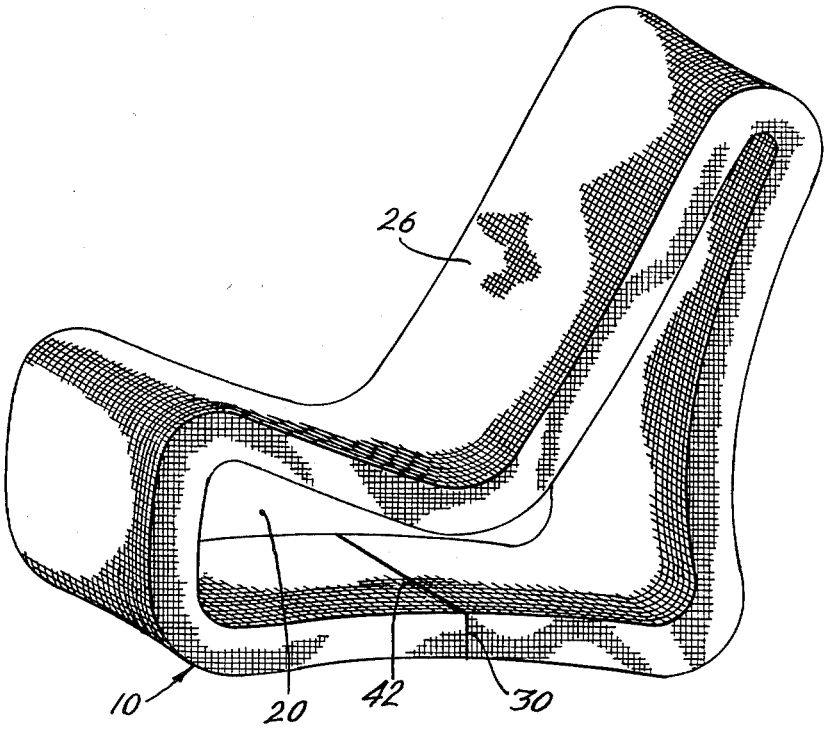
FIG. 5 is the article of furniture shown in FIGS. 3 and 4, wherein the fabric sleeve completely covers the frame.
Figure 6:
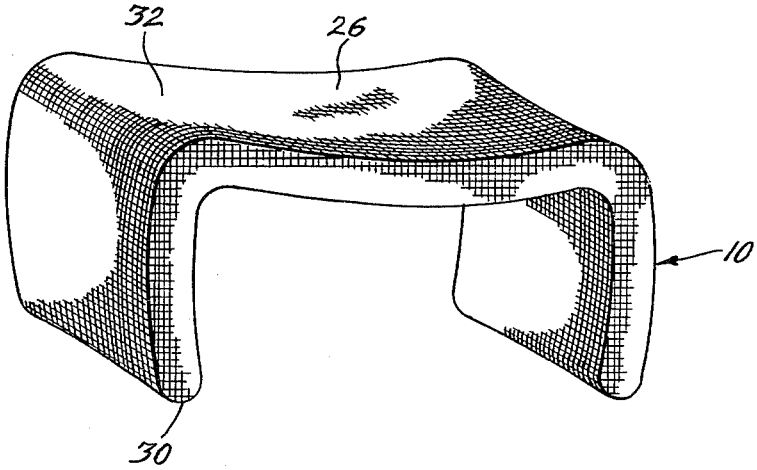
FIG. 6 is an article of furniture according to this invention, in the general coutour of an ottoman or foot rest.

As shown in FIG. 5, the only break in the fabric will be the seam 30, which marks both ends of the fabric sleeve 26, usually in the vicinity of the openings or breaks 24. If the fabric sleeve 26 is a bit too long, then either or both ends may be folded or pushed inside the peripheral frame, leaving a joint of neat appearance. Alternatively, where a removable sleeve is desired, seam 30 may comprise releasable fastening means 42, such as a zipper or VELCRO fastening strips. Where the fabric is to be resin treated, the seam may be a neatly sewn or glued hem.

In order to construct an article of furniture such as the foot rest or ottoman shown in FIG. 5, it should be apparent that it is unnecessary to form breaks or openings 24 in the peripheral frame, as the frame is not continuous. With reference to FIG. 5, the article of furniture which has a peripheral frame formed in the same manner as shown in FIGS. 1 and 2, the fabric sleeve 26 may be drawn from right to left, with a finished seam 34 being effectively hidden when the article of furniture sits on the floor or ground. Seam 30 may be formed from releasable attachment means 42.

In addition to the various contours into which articles of furniture may be manufactured, it is also contemplated to provide both rigid and soft body support surfaces. If rigid body support surfaces are desired, one need only impregnate the fabric sleeve 26 with a resinous material 32, such as polyester or epoxy resin. Naturally, if such a rigid article is required, it would be unnecessary to provide padding 22. As an alternative, it may be desirable to cover the article of furniture with a softer fabric or to employ suitable pillows or cushions, not shown.

It should also be noted that the number of cross braces 14, which are required, will depend upon the overall size of the particular article of furniture, as well as whether the article of furniture will be padded or made rigid. In the case where padding is employed, it is desirable to provide cross braces at intervals of approximately 6" along the body support area which will be covered by the padding. Fewer braces will be necessary when the fabric is to be subsequently resin treated. Generally speaking, those portions of the peripheral frame which correspond to body support surfaces will require more braces than other portions of the peripheral frame. This is apparent from the disposition of the braces in FIG. 1.

It should be understood that the use of other materials and securing means for the peripheral frame are contemplated by this invention. The materials may comprise metals, such as aluminum or steel, and the securing means may include pin and dowel arrangements, rivets, brackets and the like. Other fabrics may also be suitable for use in practicing this invention, as well as other padding materials.

The present invention may be embodied in other specific forms without departing from the spirit or essential attributes thereof, and accordingly, reference should be made to the appended claims, rather than to the foregoing specification as indicating the scope of the invention.

I claim:

1. An article of furniture, comprising:
a self-supporting peripheral frame, defining a body contour and an open central region, the entire frame bordering said open region; and,
a fabric sleeve, substantially covering said peripheral frame and providing a body support surface.

2. The furniture article of claim 1, wherein said peripheral frame defines a general body contour.

3. The furniture article of claim 1, wherein said peripheral frame defines a customized body contour.

4. The furniture article of claim 1, wherein said peripheral frame comprises two side rail members and a plurality of braces connecting said rail members, said braces being disposed substantially parallel to and adjacent said open central region.

5. The furniture article of claim 1, wherein said fabric sleeve is impregnated with a resinous material, thereby providing a substantially rigid body support surface and reducing the need for reinforcement of the frame.

6. The furniture article of claim 1, further comprising padding disposed between said body support surface of said sleeve and said peripheral frame.

7. The furniture article of claim 4, further comprising padding disposed between said body support surface of said sleeve and those of said braces adjacent thereto.

8. The furniture article of claim 1, wherein said fabric sleeve is a one-piece stretch member, slipped over substantially all of said peripheral frame through an opening therein.

9. The furniture article of claim 2 or 3, wherein the contour of said peripheral frame substantially defines a chair.

10. The furniture article of claim 2 or 3, wherein the contour of said peripheral frame substantially defines a recliner.

11. The furniture article of claim 2 or 3, wherein the contour of said peripheral frame substantially defines an ottoman.

12. The furniture article of claim 1, wherein the fabric sleeve is joined to itself by releasable attachment means.

13. The furniture article of claim 1, wherein said peripheral frame is formed in a continuous piece, which must be opened at one point before drawing said sleeve over said peripheral frame.

14. A method of furniture construction, comprising the steps of:
forming a peripheral frame, defining an open central region and a desired contour, the entire frame bordering said open region; and,
drawing a fabric sleeve over substantially all of said peripheral frame, thereby covering said peripheral frame and providing a body support surface.

15. The method of claim 14, wherein the peripheral frame is formed in a continuous shape, and opened prior to drawing the fabric sleeve thereover.

16. The method of claim 15, wherein said peripheral frame is rejoined after said fabric sleeve is drawn thereover.

17. The method of claim 16, wherein end members are attached to the frame, adjacent the opening, the end members being then attached to one another.

18. The method of claim 14, further comprising the step of impregnating the fabric sleeve with a resinous material, thereby providing a rigid body support surface and reducing the need for reinforcing the frame.

19. The method of claim 18, further comprising the step of drawing a second fabric sleeve over the resin treated fabric sleeve.

20. The method of claim 14, wherein the peripheral frame is formed by joining two side rail members by a plurality of cross braces.

21. The method of claim 20, further comprising the step of mounting padding over those of said cross braces under the body support surface, prior to drawing said fabric sleeve over said peripheral frame.

* * * * *